United States Patent [19]

Lane et al.

[11] Patent Number: 4,694,656

[45] **Date of Patent: * Sep. 22, 1987**

[54] ROTARY RELEASE ICE MACHINE AND METHOD

[76] Inventors: Robert C. Lane; Joseph M. Lee, both of 2030 Richmond, Houston, Tex. 77098

[ * ] Notice: The portion of the term of this patent subsequent to Aug. 25, 2004 has been disclaimed.

[21] Appl. No.: 827,083

[22] Filed: Feb. 7, 1986

[51] Int. Cl.[4] ..... F25C 1/12

[52] U.S. Cl. ..... 62/72; 62/74; 62/347

[58] Field of Search ..... 62/72, 74, 347, 348, 62/352

[56] References Cited

U.S. PATENT DOCUMENTS

| | | | |
|---|---|---|---|
| 2,616,271 | 11/1952 | Knowles | 62/347 X |
| 3,929,256 | 12/1975 | Solomon | 62/72 X |
| 4,549,408 | 10/1985 | Lee et al. | 62/347 X |
| 4,589,264 | 5/1986 | Ohashi et al. | 62/347 X |
| 4,590,774 | 5/1986 | Povajnuk | 62/347 |

*Primary Examiner*—William E. Tapolcai
*Attorney, Agent, or Firm*—Matthews & Associates

[57] ABSTRACT

The method of repetitively making discrete blocks of ice which is performed with apparatus having a plurality of adjacently disposed ice freezing pockets formed with a refrigeration evaporator as the base of each pocket of the pockets, horizontally extending and vertically spaced apart evaporator fins as the sides of the pockets, and horizontally pivotal vertical plates as the ends of the pockets. A refrigeration apparatus is provided to alternately freeze the refrigeration evaporator of the ice freezing pockets and very quickly and very briefly heat the refrigeration evaporator directly to loosen the ice blocks from the freezing pockets. Apparatus is provided to apply a force to the vertical plates until the immediate surfaces of the ice blocks are melted and loosened from the freezing pockets. The vertical plates thereon move the ice blocks within the freezing pockets, then are rapidly returned to an initial position which ejects the ice blocks completely from the freezing pockets.

22 Claims, 12 Drawing Figures

ROTARY RELEASE ICE MACHINE AND METHOD

FIELD OF THE INVENTION

This invention generally relates to methods and apparatus for making cubed ice in quantities suitable for restaurants, hotels, motels and the like. More particularly, this invention pertains to a method and apparatus for making cubed ice in quantities significantly greater than provided in the prior art with apparatus of the same size.

This application is co-pending with commonly assigned application Ser. No. 827,094, filed Feb. 7, 1986.

BACKGROUND OF THE INVENTION

The nearest known prior art to the present invention is the method and apparatus disclosed in Lee, et al., U.S. Pat. No. 4,549,408 which has common inventorship with the present invention and is commonly assigned with the present invention. The references cited in U.S. Pat. No. 4,549,408 are of note. Lee, et al. disclose ice maker apparatus including a triple walled stationary evaporator drum disposed with a plurality of equally spaced radially outwardly projecting ridges. Evenly distributed water flow over the drum freezes as a layer of ice on the freezing surface of the drum and the ice is intermittenly removed into broken and sized cubes by a sequentially functioning cutter assembly.

Lee, et al. note that prior art ice makers require the provision of some form of heat to the evaporator drum surface in the removal of ice and that such procedure is energy inefficient since a tremendous amount of energy is expended to freeze, heat, and refreeze the surface upon which the ice is formed. While this statement is generally true, the present invention is in exception in that the mass of material to be heated is very small, the heating cycle is very short, and the transition from freezing, to heating, to freezing, is very rapid, as later shown.

The present invention will produce well shaped dry cubes of ice in quantities much greater than the prior art apparatus of equal size as disclosed in the prior patents.

OBJECTS OF THE INVENTION

The principle object of the present invention is to provide a method and apparatus for producing cubed ice in a freezing evaporator and storage structure much greater than can be provided by the prior art.

Another object of the present invention is to provide a cubed ice making method and apparatus wherein the unit cost for the cubed ice is much less than that of the prior art of comparable size.

Another object of the present invention is to provide a method and apparatus for making cubed ice wherein the ice cubes are well formed, frozen, and maintain a good form and shape when going into storage for use.

Yet another object of the present invention is to provide ice cube making apparatus which is comparatively simple in structure, yet very good functionally, in freezing the ice cubes and removing the frozen cubes for subsequent storage.

SUMMARY OF THE INVENTION

The foregoing and other objects of the present invention are attained by the method of repetitively making discreet blocks of ice which is performed with apparatus having a plurality of adjacently disposed ice freezing pockets formed with a refrigeration evaporator as the base of each pocket of the pockets, horizontally extending and vertically spaced apart evaporator fins as the sides of the pockets, and horizontally moveable vertical plates as the ends of the pockets. A refrigeration apparatus is provided to alternately freeze the refrigeration evaporator of the ice freezing pockets and very quickly and very briefly heat the refrigeration evaporator directly to loosen the ice blocks from the freezing pockets. Apparatus is provided to apply a force to the vertical plates to urge the plates from a first position horizontally toward a second position until the immediate surfaces of the ice blocks are melted and loosened from the freezing pockets. The vertical plates thereon move the ice blocks within the freezing pockets, then are rapidly returned to the first position which ejects the ice blocks completely from the freezing pockets. The heat exchange within each block of the ice blocks is such that the immediate surface of the ice block, which was melted in the ice pocket, refreezes with the heat causing melting being absorbed by the total ice block. The freezing and ejection cycle as described is repetitive and continuous. The refrigerant tubes of the evaporator form the base of the ice freezing pockets and these tubes, along with the sides of the freezing pockets, are the only mass involved for the rapid change in temperature and the brief heating cycle to loosen the ice blocks from the freezer pockets.

DESCRIPTION OF THE PREFERRED EMBODIMENT

Figure 1:
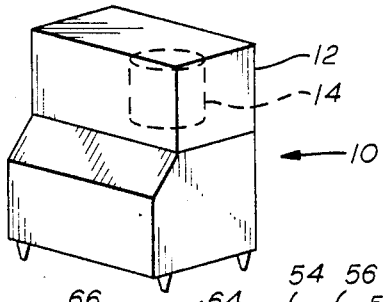
FIG. 1 is a schematic perspective view of an ice machine of the present invention.
Figure 2:
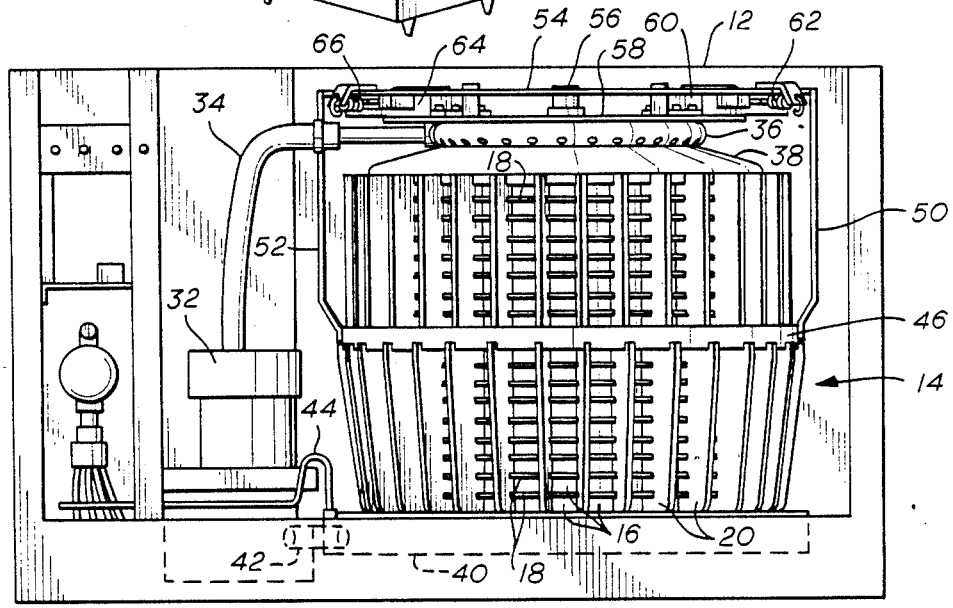
FIG. 2 is a front elevation of the freezer unit of FIG. 1 with the front cover removed.
Figure 3:
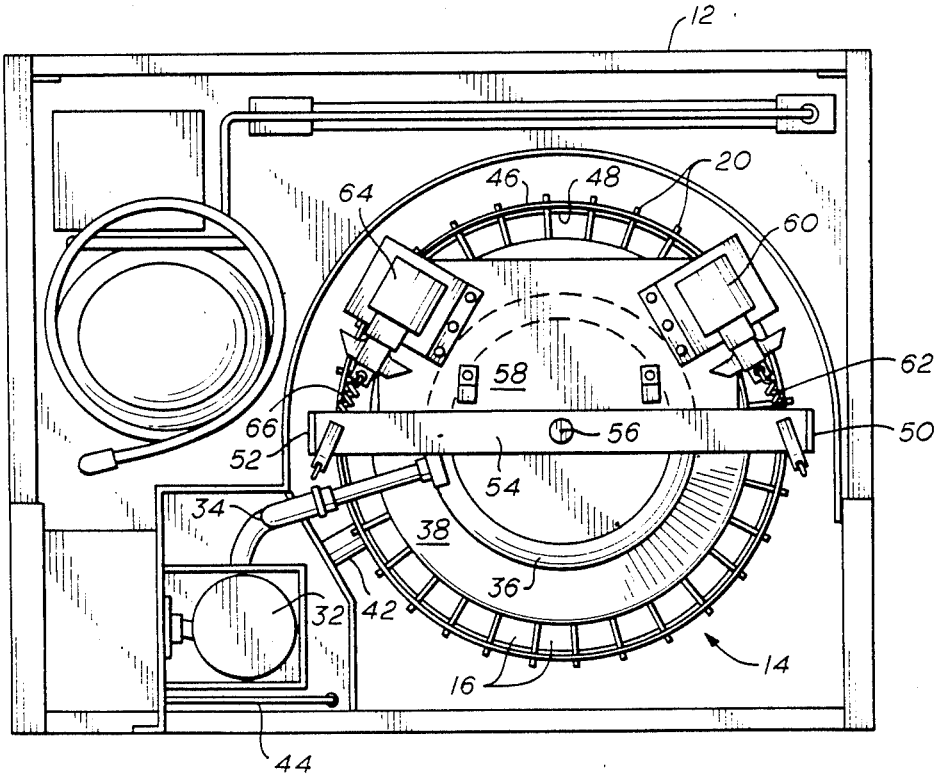
FIG. 3 is a plan view of the freezer unit of FIG. 1 with the top removed.
Figure 4:
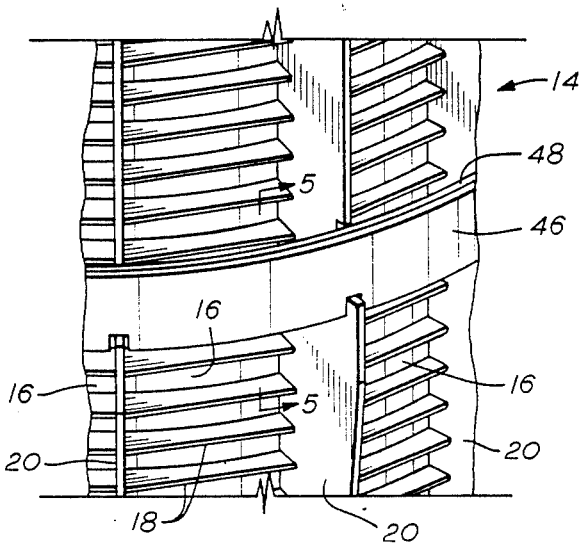
FIG. 4 is an enlarged portion of the front elevational view of FIG. 2, showing the horizontal freezer fins and the movable vertical plates in more detail.

FIG. 1 shows a typical ice making machine 10 with which is installed a freezer unit 12 of the present invention and including an ice cube freezing evaporator structure 14, more clearly shown in FIGS. 2–4. Around the circumference of the evaporator structure 14 is provided a multiplicity of cube ice freezing pockets 16 best shown in FIG. 4.

Vertically spaced and horizontally extending evaporator fins 18 form sides to the pockets 16.

Vertically extending spaced apart, movable plates 20, form the other sides or ends of the freezer pockets 16.

Figure 5:
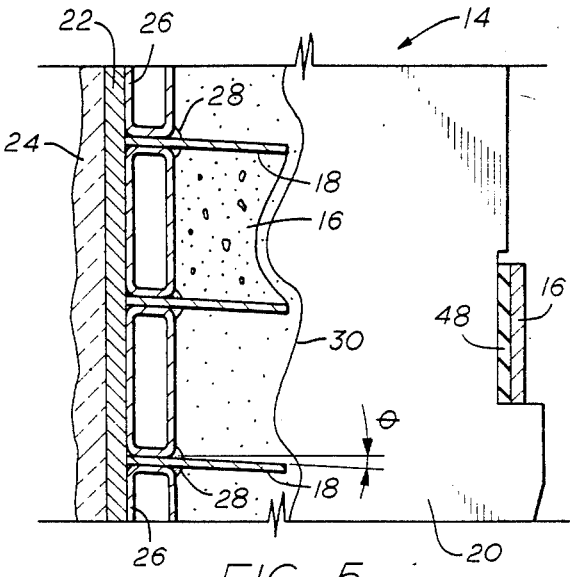
FIG. 5 is a cross-sectional view taken along the line 5—5 of FIG. 4 and showing a detailed section of the ice freezer elements of a particular sample of the ice freezer pockets and constituent parts thereof.
Figure 9:
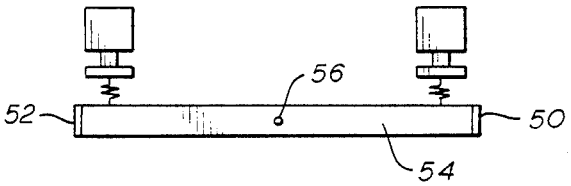
FIG. 9 is a schematic elevational view of the solenoid and lever mechanism for moving the plates of FIG. 6 while de-energized with the plates disposed as shown in FIG. 6.

As best shown in FIG. 5, the bottoms or base of the pockets 16 are formed directly by evaporator coils 26. Coils 26 are oblately shaped to form a flat surface as shown. The coil 26 and the fins 18 are attached together and to an evaporator drum wall 22 by means of a soldering material 28 such as silver solder, tin or other suitable non-toxic metal alloy. The drum wall 22 is backed up on its other side by an insulating material 24 which purpose is to insulate the drum wall 22 against heat transfer.

Referring now to FIGS. 2 and 3, there is shown a chilled water recirculating system including a circulating pump 32 connected through a pipe 34 to a water distribution ring pipe 36. Ring pipe 36 has an even distribution of holes around its circumference which allow passage of an even flow of water down onto a flow distribution dome 38 which evenly carries the flow of water to the top periphery of the evaporator structure 14 thereby allowing an even flow of water off the edge of the dome 38 into successive contact with the fins 18 as the water flows from the dome 38 down across the fins 18 into a sump 40, shown in FIG. 2.

It is to be noted, with reference to FIG. 4, that the generally circular fins 18 are more specifically polygonal in shape with each segment of fin 18 between the plates 20 being a straight edge. The straight edge enhances an even flow of water across the length of that edge. Also the fins 18 may extend outwardly and slightly downwardly from the drum wall 22.

Water from the sump 40 thereon drains through a pipe 42 into the intake of the pump 32 for recirculation. Water which is removed (by its formation into ice) by the evaporator structure 14 is made up from outside the system through a make up pipe 44. A float valve (not shown) or similar device provides water through the make up pipe 44 only as needed.

A hoop strap 46 is disposed around the evaporator structure 14 and is notched to engage each of the movable, vertical plates 20 as shown in FIGS. 2–5. As the strap 46 is pivoted in different directions, the strap forceably pivots the vertical plates 20 into positions shown in FIGS. 6–8. A cushioning belt 48 accomodates the pivoting action between the plates 20 and the strap 46. Belt 48 may be provided of rubber, for example.

Figure 6:
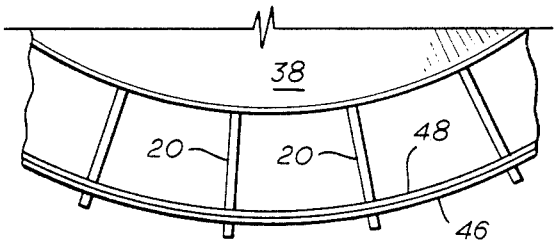
FIG. 6 is an enlarged view of a segment of the evaporator structure as shown in FIG. 3 with the movable vertical vanes disposed in the neutral position assumed during freezing of ice blocks.
Figure 10:
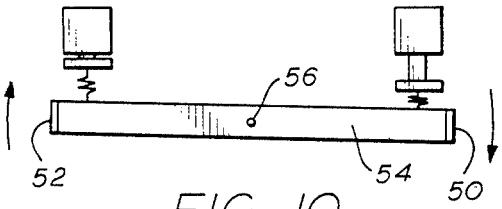
FIG. 10 is the solenoid and lever mechanism of FIG. 7 in energized position to move the plates of FIG. 7 to the position shown.

Looking now to FIGS. 2, 3, and 9–11, the hoop strap 46 is connected on its diameter to vertical transfer bars 50 and 52 which in turn, are connected to the upper ends of a transfer lever 54. Lever 54 pivots about a pivot 56 which is mounted on mounting plate 58 and is centered with dome 38. A plate actuator solenoid 60 is mounted through a spring 62 to the end of lever 54 which connects to bar 50. A plate retraction solenoid 64 is connected through a spring 66 to lever 54 at the end of the lever connected to bar 52. With the linkage arranged as shown, solenoid 60 is first energized, stretching spring 62, and to some extent spring 66, and thereby urges the plates 20 as shown in FIG. 6 to move in horizontal pivoting motion toward the position shown in FIG. 7.

However, though being urged to move, the plates 20 do not in fact move until such time as the immediate surfaces of ice blocks in the pockets 16 are sufficiently melted loose to respond to such urging of spring 62 and thereby come loose within the pockets. At this time, the plates 20 do move from the positions of FIG. 6 to the position of FIG. 7 and the ice blocks are thereby partially dislodged within pockets 16.

Figure 7:
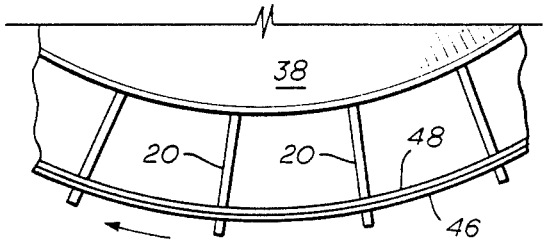
FIG. 7 is the same view as FIG. 6 at an instant when the vanes have been moved to dislodge ice blocks and before the vanes are abruptly returned to eject ice blocks.
Figure 11:
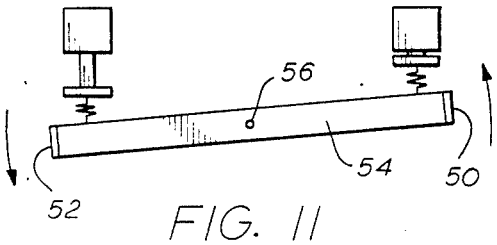
FIG. 11 is the solenoid and lever mechanism of FIG. 8 when ejecting ice.

As soon as plates 20 reach the position shown in FIG. 7, a micro-switch (not shown) is actuated to de-energize activator solenoid 60 and to energize the retraction solenoid 64.

Solenoid 64 increases the stretch and consequent urging of tension spring 66 while the spring 62 is released. This action serves to abruptly move or "whip" the plates 20 back through the position shown in FIG. 6 to the position shown in FIG. 8. This action forceably ejects the ice from the pockets 16 to be received in a storage bin under the freezer unit 12 of the machine 10. The solenoid 64 is then released and freezing cycle is resumed.

Figure 12:
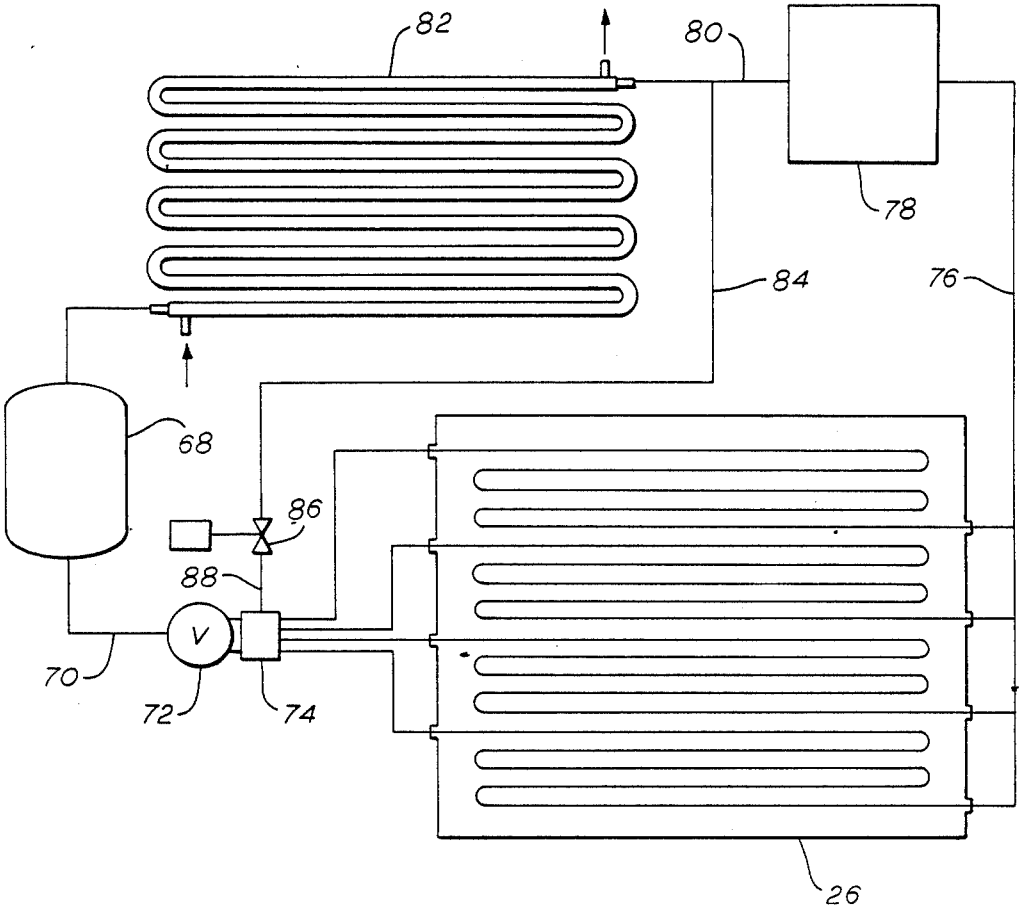
FIG. 12 is a schematic illustration of the refrigeration apparatus used in the present invention and showing the reverse cycle feature for rapidly heating, then cooling, the evaporator coils.

The refrigeration apparatus is partially shown in FIGS. 2, 3, and 5 and more completely, though schematically, in FIG. 12. As shown, a liquid refrigerant such as "Freon - 12" is stored in an accumulator 68 under pressure. The refrigerant is fed through a liquid line 70 through a expansion control valve 72 to a distributor header 74. From the distributor header 74, the refrigerant is fed into several evaporator coils 26 which are arranged around the drum 22 in parallel arrays as part of the integral structure shown in FIG. 5. The coils 26 feed into a return suction line 76 which is connected to the suction side of a compressor 78. The refrigerant is compressed by the compressor 78 to a high pressure and temperature and discharged through a discharge line 80 into a water cooled condenser 82 which condenses the hot gas back into a liquid which is drained into accumulator 68 for reuse.

A hot gas bypass line 84 is connected from discharge line 80 through a normally closed solenoid valve 86 and a line 88 into the distributor header 74 as shown, or at an equivalent location.

During a freezing cycle of the freezing evaporator structure 14, the refrigerating apparatus, as shown in FIG. 12, operates normally with the coils 26 freezing ice from the water. At a designated interval, 8.5 minutes being an example, the solenoid 86 is actuated, opening the valve and permitting hot gas to go from compressor 78 through line 84 and line 88 directly into the header 74 and the coils 26.

There is little mass to be heated in the freezing evaporator structure 14 as shown in FIGS. 2, 3 and 5. The structure is rapidly heated up by this hot gas to the ice melting point of 32° F. The instant that the immediate surface of ice in pockets 16 comes loose, and the plates 20 are moved to the position shown in FIG. 7 to actuate the micro-switch as previously described, the solenoid of the valve 86 is de-energized, stopping the hot gas circulation and allowing the refrigeration apparatus to resume its freezing mode and function.

In the practice of the method and in the operation of the apparatus as above described, the ice machine 10 is supplied with water and turned on to start the refrigeration apparatus. The water sump 40 is filled with water and recirculated by the circulating pump 32 from the ring pipe 36 down over the fins 18 as the water 30 shown in FIG. 5. The freezing action of the coils 26 first chill the water in the circulating system and then begins to freeze ice within the pockets 16 as previously described.

The refrigeration apparatus is cycled on a designated time period for (a) a reverse cycle to heat the coils 26 and (b) a freezing cycle to freeze ice in the pockets 16.

An electrical system (not shown) actuates the solenoid 60 and the solenoid of the valve 86 and stops the circulating pump 32 after a prescribed time, 8.5 minutes, for example. The vanes 20 are immediately urged to move the ice blocks within the ice pockets 16. Hot gas is being circulated through the coils 26 to heat the pockets to loosen the ice blocks. The pump 32 is off. After a short period, 0.75 to 1.5 minutes being an example, the ice comes loose within the ice pockets 16, the plates 20 are moved with the position shown in FIG. 7 and the micro-switch is actuated.

Actuation of the micro-switch energizes the retraction solenoid 64, de-energizes the activator coils solenoid 60, de-energizes the solenoid to valve 86 and starts the pump 32. The solenoid 64 is then de-energized.

Figure 8:
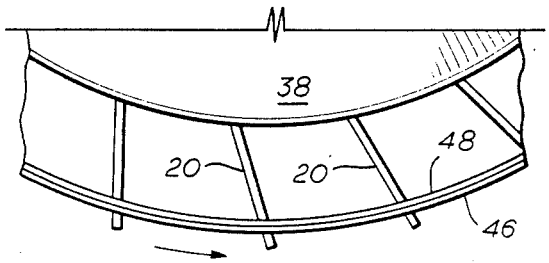
FIG. 8 is the same view as FIG. 6 at an instant that the vanes are whipped past the neutral position when ejecting ice.

With these actions, the ice is ejected by the vanes 20 as shown in FIG. 8 into the storage bin and flow of water over the freezer structure 14 is resumed. The refrigeration apparatus again is freezing and the water 30 is again frozen into ice within the freezer pockets 16 for a succeeding 8.5 minutes. This cycle of making and ejecting ice continues so long as water is supplied and the refrigeration apparatus with its electrical controls continue in operation.

It is to be noted that the water coating on the ice blocks, when the blocks are initially broken loose from the freezer pockets 16, quickly becomes "dry". The ice blocks, after ejection from the freezer pockets 16, are dry since the heat in the water phase is quickly absorbed in the remainder of the ice block.

This feature of having dry ice blocks dropping into the freezer storage compartment of the ice machine 10 differs considerably over previous state of the art machines where the ice in the storage bin is usually wet, melting, and fusing together.

It is to be noted that changes and modifications of some substance may be made to the embodiment of the invention as herein illustrated and described, all without departing from the purview and scope of the invention as defined in the appended claims.

We claim:

1. A repetitive method for making discrete blocks of ice comprising:

(a) flowing chilled water over the openings of a plurality of vertically disposed ice freezing pockets which are formed with a freezing refrigeration evaporator as the base of each pocket of said pockets, horizontally extending and vertically spaced apart evaporator fins as the sides of said each pocket and horizontally movable vertical plates as the ends of said each pocket;

(b) allowing said chilled water coming into contact with said base, said fins, and said plates to freeze and build up ice to fill said pockets and form ice blocks during a designated time period;

(c) applying a force to said vertical plates to urge said plates from a first position toward a second position while concurrently causing said evaporator, said fins, and said plate to be heated for a designated time period to a temperature sufficient to melt free only the immediate surfaces of said ice block from said pockets;

(d) moving said plates from said first position to said second position and thereby moving said ice blocks within said pockets toward removal of said ice blocks from said pockets in response to said force applied to said plate at the instant that said ice blocks are melted free from said pockets; and (e) returning said plate to said first position and thereby completing ejection of said ice blocks from said pockets.

2. The method of claim 1 wherein said ice freezing pockets are disposed around the circumference of a cylindrical freezing refrigeration evaporator with said evaporator fins defining a straight edge between said vertical plates.

3. The method of claim 2 further including the steps of receiving and storing said ice blocks in a storage container.

4. An apparatus for repetitively making discrete blocks of ice comprising:

(a) a plurality of vertically disposed ice freezing pockets which are formed with a refrigeration evaporator as the base of each pocket of said pockets, horizontally extending and vertically spaced apart evaporator fins as the sides of said pocket, and horizontally movable vertical plates as the ends of said pocket;

(b) refrigeration means for freezing said base and said sides of said pocket;

(c) means for circulating chilled water over the openings of said pockets;

(d) means for running said refrigeration means through a freezing cycle extending for a designated time period sufficient to allow said chilled water coming into contact with said base, said fins and said plates to freeze and build up as ice to fill said pockets and form ice blocks;

(e) means for operating said refrigeration means through a heating cycle for a time period sufficient to melt only the immediate surfaces of said ice blocks;

(f) means to apply force to said vertical plates to urge said plates from a first position horizontally toward a second position until said immediate surfaces are melted from said pockets and thereafter moving said plates from said first position to said second position thereby to move said ice blocks within said pockets responsive to said force when the ice blocks are melted free from said pockets;

(g) means for returning said plates to said first position thereby to completely eject said ice blocks from said pockets; and (h) means for returning said refrigeration means to said freezing cycle.

5. The apparatus of claim 4 wherein said evaporator is cylindrical in shape with said freezing pockets extending around said evaporator.

6. The apparatus of claim 5 wherein said means for circulating chilled water includes a circulating ring means for evenly distributing said chilled water around the periphery of said evaporator.

7. The apparatus of claim 4 wherein said evaporator is comprised of flattened coils formed around a thin metal drum and disposed between said evaporator fins.

8. The apparatus of claim 7 wherein said coils, said drum and said evaporator fins are joined together as a unit with solder.

9. The apparatus of claim 4 wherein said means to apply force includes means driven by electrical solenoid means.

10. The apparatus of claim 9 wherein said means for returning said plates is included with said means to apply force.

11. The apparatus of claim 4 wherein said means for operating said refrigeration means through a heating cycle includes solenoid valve means connected to divert compressed hot refrigerant directly into said refrigeration evaporator.

12. The apparatus of claim 6 wherein said evaporator is comprised of flattened coils formed around a thin metal drum and disposed between said evaporator fins; wherein said coils, said drum and said evaporator fins are joined together as a unit with solder; wherein said means for returning said plates is included with said means to apply force; wherein said means for operating said refrigeration means through a heating cycle includes solenoid valve means connected to divert compressed hot refrigerant directly into said refrigeration evaporator.

13. The apparatus of claim 4 wherein said evaporator is of cylindrical shape with said evaporator fins extending as a polygon around said evaporator as a straight edge between said vertical plates and with said vertical plates being pivotally mounted in spaced apart relation around said evaporator for pivoted horizontal movement.

14. The apparatus of claim 4 wherein said chilled water is circulated to provide flow over said freezing pockets by means of pump means which draws said chilled water from a sump located under said pockets.

15. The apparatus of claim 4 wherein said refrigeration evaporator is connected into refrigeration means which evaporates liquid refrigerant in said evaporator for freezing and alternately which circulates hot refrigerant gas through said evaporator for heating.

16. The apparatus of claim 4 wherein each evaporator fin of said evaporator fins extends away and slightly downwardly from said evaporator.

17. The apparatus of claim 4 wherein said each vertical plate is pivoted on centers located away from the inner edges of said plates and.

18. An article of manufacture suitable for making ice blocks including a vertically disposed plurality of ice freezing pockets with each pocket of said freezing pockets comprising in combination:

(a) a directly refrigeratable freezing member forming the base of each pocket;

(b) at least two vertically disposed apart and horizontally extending fins attached with each freezing member and forming the sides of said pocket;

(c) at least two horizontally pivotable and vertically disposed plates mounted contiguously with said freezing member and said extending fins to form the ends of each said pocket of said plurality of pockets;

(d) said freezing member being of cylindrical shape with said fins extending around said freezing member and with said vertically disposed plates being pivotally mounted in spaced apart relation around said freezer for pivoted horizontal movement; and (e) each of said vertically disposed plates being pivoted on centers located away from its inner edge.

19. The article of claim 18 wherein each evaporator fin of said evaporator fins extends away and slightly downwardly from said evaporator.

20. The article of claim 18 wherein said freezing member is comprised of flattened coils formed around a thin metal drum and disposed between said evaporator fins.

21. The article of claim 18 wherein said plate member and said fins are joined together as a unit with solder.

22. The article of claim 18 wherein the outer edges of said fins are polygonal in shape with straight edges between said plates.

* * * * *